United States Patent [19]

Thomas, III

[11] Patent Number: 4,759,577

[45] Date of Patent: Jul. 26, 1988

[54] DOOR SECURITY APPARATUS

[76] Inventor: James A. Thomas, III, P.O. Box 9007, Scottsdale, Ariz. 85252-9007

[21] Appl. No.: 926,219

[22] Filed: Nov. 3, 1986

Related U.S. Application Data

[63] Continuation-in-part of Ser. No. 781,349, Sep. 30, 1985, Pat. No. 4,666,195, which is a continuation-in-part of Ser. No. 733,040, May 13, 1985, abandoned.

[51] Int. Cl.[4] ..... E05C 3/08

[52] U.S. Cl. ..... 292/338; 292/DIG. 15; 292/DIG. 49

[58] Field of Search ..... 292/338, 339, 218, 97, 292/123, 196, 233, 217, DIG. 15, 158, DIG. 49

[56] References Cited

U.S. PATENT DOCUMENTS

| | | | |
|---|---|---|---|
| 258,127 | 5/1882 | Rosenthal | 292/233 |
| 1,625,238 | 4/1927 | Bradley | 292/218 X |
| 1,661,240 | 3/1928 | Trimbach | 292/DIG. 15 X |
| 1,713,932 | 5/1929 | Strid | 292/218 |
| 2,510,019 | 5/1950 | Holland | 292/123 X |
| 2,589,872 | 3/1952 | Schetky | 292/97 X |
| 2,815,085 | 12/1957 | Whipple | 292/196 X |
| 4,494,784 | 1/1985 | Haynes | 292/338 X |

*Primary Examiner*—Richard E. Moore

*Attorney, Agent, or Firm*—William W. Holloway

[57] ABSTRACT

A door security apparatus for preventing undesired opening of a door includes a rockshaft journaled for pivotal movement at the bottom edge of the door and having at least one stop arm extending therefrom is disclosed. An operating device is connected to the rockshaft or to a stop arm for pivoting the rockshaft to move the stop arm into and out of door bracing engagement with the floor proximate the door.

10 Claims, 2 Drawing Sheets

DOOR SECURITY APPARATUS

CROSS REFERENCE TO RELATED APPLICATIONS

This application is a continuation-in-part of a copending U.S. Patent Application, entitled DOOR SECURITY APPARATUS having Ser. No. 06/781,349 and filed on Sept. 30, 1985, now U.S. Pat. No. 4,666,195 having been issued on May 19, 1987, by the same inventor; which application is a continuation-in-part of a U.S. Patent Application, entitled DOOR BRACE having Ser. No. 06/733,040 and filed on May 13, 1985, now abandoned by the same inventor.

BACKGROUND OF THE INVENTION

1. Field of the Invention

This invention relates in general to security devices and more particularly to a bracing device for use on the interior surface of a door to prevent unauthorized opening thereof.

2. Description of the Related Art

The most commonly used and most effective door security device is the dead bolt lock for preventing unauthorized entry through the door of a residence. However, skilled burglars can, and often do, gain entry.

Briefly, there are two types of dead bolt locks, namely those which are operated manually on the interior side of the door and those which must be operated with a key on both sides of a door. The latter of these types of dead bolts is recommended for maximum security and when a door is provided with the recommended type of dead bolt, no visual indication that the lock has been set is present. This feature, in addition to forgetfulness, often results in dead bolt locks being left unset.

Further, the installation work required to retrofit an existing door with a dead bolt lock is beyond the skills of many people. And, many residential occupants are unable, or unwilling, to pay someone else to make the installation.

Another type of door security device in relatively common usage is a chain device in which one end of the chain is fixed to a bracket carried on the door and is selectively connectable to another bracket that is mounted on the door jamb. This type of security device allows a door to be opened a few inches before the chain is moved into a taut position wherein it is intended to prevent further opening of the door. However, once the door is opened those few inches, which opening is relatively easy for an experienced burglar to accomplish, the chain can be easily cut. Also, once opened those few inches, the door can be opened the rest of the way by a burglar forcefully pushing on the door so that one or the other, or both, of the mounting brackets will be pulled loose from their mounted positions.

Therefore, a need exists for a new and useful door security apparatus which overcomes the drawbacks and shortcomings of the prior art door security devices against unauthorized intrusion.

SUMMARY OF THE INVENTION

In accordance with the present invention, a new and useful door security apparatus is disclosed for use in providing security against unauthorized opening of a door. The door security apparatus, according to a first embodiment, includes a door brace having rockshaft with at least one stop arm extending therefrom with the extending end of the stop arm preferably having a friction foot thereon. The rockshaft is pivotably journaled for rotation about its longitudinal axis in spaced-apart pair of pillow block brackets which are screwed or otherwise attached to the interior surface of the door in a position wherein the rockshaft is proximate and parallel with respect to the lower edge of the door. Pivot movement of the rockshaft allows the stop arm to be moved between an active, or set, position wherein the stop arm extends angularly downwardly from the rockshaft, and thus the door, into engagement with the floor in the vicinity of the door to brace positively the door against unauthorized opening, and an inactive, or unset, position wherein the stop arm is out of engagement with the floor so that the door may be opened.

The door security apparatus of the present invention further includes an operating means by which the rockshaft of the door brace may be pivotably moved to move the stop arm between its active and inactive positions, and for lockingly holding the rockshaft and the stop arm in the inactive position. The operating means is preferably configured to allow remote operation, e.g. operation may be accomplished without requiring that the user kneel or stoop down to reach the door brace of the security apparatus. To accomplish the preferred remote operation, a lever is mounted on one end of the rockshaft and a pull rod is pivotably and loosely connected to the extending end of the lever. The pull rod extends upwardly from the lever and is supported in the upstanding position by a bracket means which, in addition to its supporting function, allows the pull rod to be moved up and down to produce the needed pivot movement of the rockshaft and allows the pull rod to be latchingly held in the up position wherein the spot arm is in its inactive position. The door security apparatus, according to a second embodiment, has the pull rod activated by a lever and coupled to either of a plurality of stop arms (for convenient positioning of the lever arm), and has a latching mechanism that is automatically engaged when lever arm is moved to the (stop arm) set position.

Accordingly, it is a feature of the present invention to provide a new and useful door security apparatus which positively and reliably prevents unauthorized opening of a door.

Another feature of the present invention is to provide a new and useful door security apparatus which is easy to install and simple to use and provides a highly visible indication of its position to allow the occupant to readily ascertain whether the apparatus is in the active or inactive position.

Another feature of the present invention is to provide a new and useful door security apparatus which includes a door brace device having a rockshaft which is journaled for pivot movement proximate the lower edge of a door and has at least one stop arm extending therefrom for movement between an active position wherein the stop arm is in door bracing engagement with the floor in the vicinity of the door, and an inactive position wherein the stop arm is out of engagement with the floor to allow the door to be opened.

Still another feature of the present invention is to provide a door security apparatus of the above described character and further including an operating means attached to the rockshaft or stop arm of the door brace device for pivotably moving the rockshaft, and moving the stop arm between its active and inactive positions.

Yet another feature of the present invention is to provide a door security apparatus of the above described character wherein the operating means extends upwardly from the rockshaft of the door bracing device to proximate the door knob of the door to allow remote operation of the door brace device.

The foregoing and other features of the present invention as well as the invention itself, may be more fully understood from the following description when read in conjunction with the accompanying drawings.

DESCRIPTION OF THE PREFERRED EMBODIMENT

Figure 1:
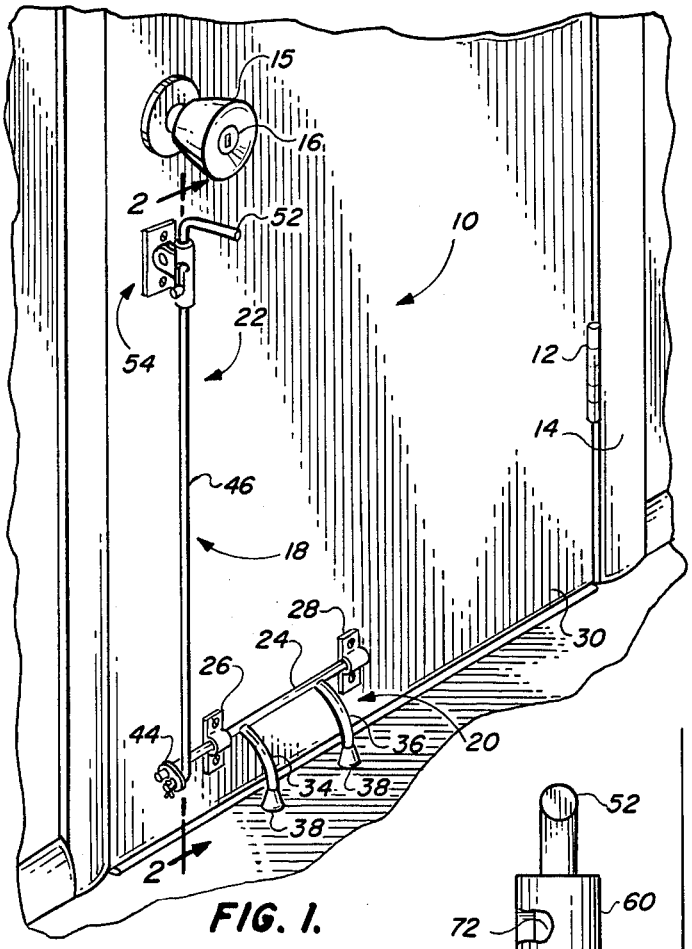
FIG. 1 is a fragmentary perspective view of the interior surface of a typical residential door having the door security apparatus of the present invention mounted thereon.

Referring more particularly to the drawings, FIG. 1 shows a typical inwardly opening residential type door 10 which is hingedly mounted by suitable butt hinges 12 (one shown) in a door frame, or jamb, 14. The door 10 is provided with the usual knob 15 for manual manipulation of a latching mechanism (not shown), which, as is customary, is normally equipped with a locking device that is operated by a key from the outside and a thumb latch 16, or functional equivalent, from this inside.

As will hereinafter be described in detail, the door 10 is equipped with the door security apparatus of the present invention which is indicated in its entirety by the reference numeral 18. And, the door security apparatus 18 includes the major components, or assemblies, of a door brace device 20 and an operating means 22.

The door brace device 20 includes a rockshaft 24 which defines a longitudinal axis 25 and which is journaled for rotation about its longitudinal axis in a mounting means which is preferably in the form of the illustrated pillow block brackets 26 and 28. The brackets 26 and 28 are screwed as indicated by numeral 29, or otherwise attached to the inwardly facing surface 30 of the door 10 and are provided with suitable bushings (not shown) in which the rockshaft 24 is journaled. The brackets 26 and 28 are located proximate the lower edge 31 of the door 10 and are disposed so that the rockshaft 24 is substantially parallel with the lower edge 31 of the door and is spaced therefrom as seen best in FIG. 2.

At least one, and preferably the two illustrated, or more, stop arms 34 and 36 extend from the rockshaft 24 at spaced apart locations along the length thereof and the stop arms 34 and 36 extend in planes which are generally normal with respect to the longitudinal axis of the rockshaft 24. Each of the stop arms 34 and 36 has a friction foot means 38 on its extending end. The friction foot means 38 are formed of rubber or other similar material which will resist skidding along the surface of the floor 40 adjacent the door 10 for reasons which will become apparent as this description progresses.

The stop arms 34 and 36 are formed integral with the rockshaft 24 such as by being cast integrally therewith, welded or the like, and are therefore movable with the rockshaft.

Figure 2:
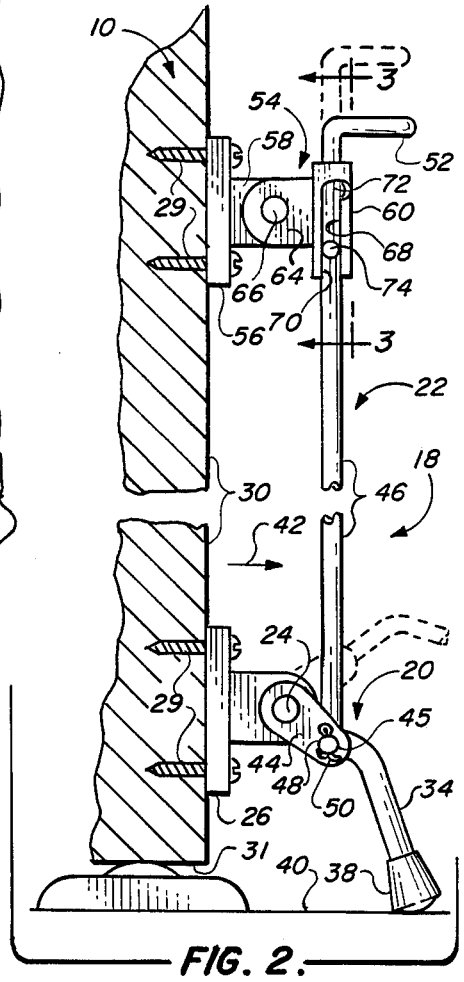
FIG. 2 is an enlarged fragmentary sectional view taken generally along the line 2—2 or FIG. 1.

The rockshaft 24, and thus the stop arms 34 and 36, are pivotably movable between an active, or set, position shown in solid lines in FIG. 2, and an inactive, or unset, position shown is dashed lines in that same figure.

When the door brace device 20 is in the above mentioned active position, the stop arms 34 and 36 extend angularly and downward from the rockshaft into engagement with floor 40 and thereby brace the door against unauthorized opening. As can be appreciated by reference to FIG. 2, forces applied in the direction of arrow 42, tending to open the door 10, will cause the arms 34 and 36 to be forced more tightly against the surface of the floor 40 in what may be described as a wedging action between the floor 40 and the door 10. Increasing the forces applied against the door in the direction of the arrow 42 will result in increasing the wedging action and thereby providing increased resistance to unauthorized opening of the door 10.

The operating means 22 may be configured in any suitable manner which facilitates accomplishment of the above described pivotable movement of the door brace device 20 and will latchingly hold the device in its inactive position. The operating means 22 is preferably configured as will hereinafter be described in detail so that the door brace device 20 can be operated from a remote, or elevated, position so as to eliminate the need of a user kneeling or stooping down to reach the device.

To accomplish the above stated objectives, a lever 44 is affixed transversely on one end of the rockshaft 24 and an aperture 45 is formed through the extending end of the lever. A pull rod 46 has its lower end bent as at 47 to provide a lug 48 which passes loosely through the aperture 45 of the lever 44 and is secured therein against axial displacement such as by means of the illustrated cotter pin 50. The pull rod 46 extends upwardly from the lever 44 so as to position a handle means 52, which is provided on its uppermost end, in the vicinity of the knob 15 of the door 10.

The pull rod 46 of the operating means 22 is supported in its upstanding position by a bracket means 54 which, in addition to its supporting function, provides means for latching the door brace device 20 in its inactive position. The bracket means 54 includes a base 56 which is screwed or otherwise attached to the inner surface 30 of the door 10 below the knob 15, and the base includes a normally extending ear 58. The bracket means 54 further includes a tubular bearing member 60 defining a bore 62 and having an ear 64 extending laterally therefrom. The ear 64 of the tubular bearing member 60 is attached by means of a pivot pin 66 to the ear 58 of the base 56 so that the bore 62 of the bearing member 60 will lie in a substantially vertical attitude and is free to pivotably deviate from that attitude.

The pull rod 46 extends loosely through the bore 62 of the bearing member 60 so as to be axially and rotatably movable therein. When the pull rod 46 is in the downwardly disposed position, as indicated in solid lines in FIG. 2, the door brace device 20 is in the active, or set, position. When the pull rod 46 is pulled upwardly to the position shown in dotted lines, the lever 44, and therefore the rockshaft 24 and the stop arms 34 and 36 will be pivotable moved about the longitudinal axis of the rockshaft 24 into the inactive position of the door brace device 20.

When the lever 44 is pivotably moved in the above described manner, its aperture 45 will follow an arcuate path about the axis of the rockshaft. Since the lug 48 of the pull rod 46 is carried in the aperture 45 of the lever 44, the lug 48 will generally follow the same arcuate path. Therefore, the pull rod 46 will deviate from its vertical attitude during its movements between upwardly and downwardly disposed positions thereof. In that the bearing member 60 is pivotably connected to the base 56 of the bracket means 54, as hereinbefore described, it will also be free to follow the deviations from the vertical attitude of the pull rod 46.

As hereinbefore mentioned, the pull rod 46 is a loose fit in the bore 62 of the bearing member 60 and if that fit is loose enough, the pivot action of the bearing member 60 will be unnecessary.

Figure 3:
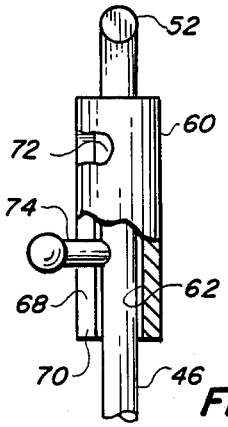
FIG. 3 is an enlarged fragmentary sectional view taken along the line 3—3 of FIG. 2.

As shown in FIGS. 2 and 3, the tubular bearing member 60 is provided with a longitudinally extending slot 68 formed in its sidewall and that slot is open as at 70 on its lower end. The upper end of the slot 68 is closed, e.g. it does not extend the entire length of the bearing member 60, but instead opens laterally into a blind latching slot 72 which extends at a right angle from the closed upper end of the longitudinal arm 74. The longitudinal arm 74 moves up and down in the longitudinal slot 68 defined by the bearing member 60 in accompaniment with the up and down movements of the pull rod.

When the pull rod 46 is pulled to its up position, it can be rotated by the user so that the arm 74 moves into the latching slot 72 so that the pull rod 46 will be latchingly held in its up position. This configuration will hold the door brace device 20 in the inactive position thereof. Rotating movement of the pull rod 46 is possible due to the loose fit of the lug 48 in the aperture 45 of the lever 44 as hereinbefore described.

Figure 4:
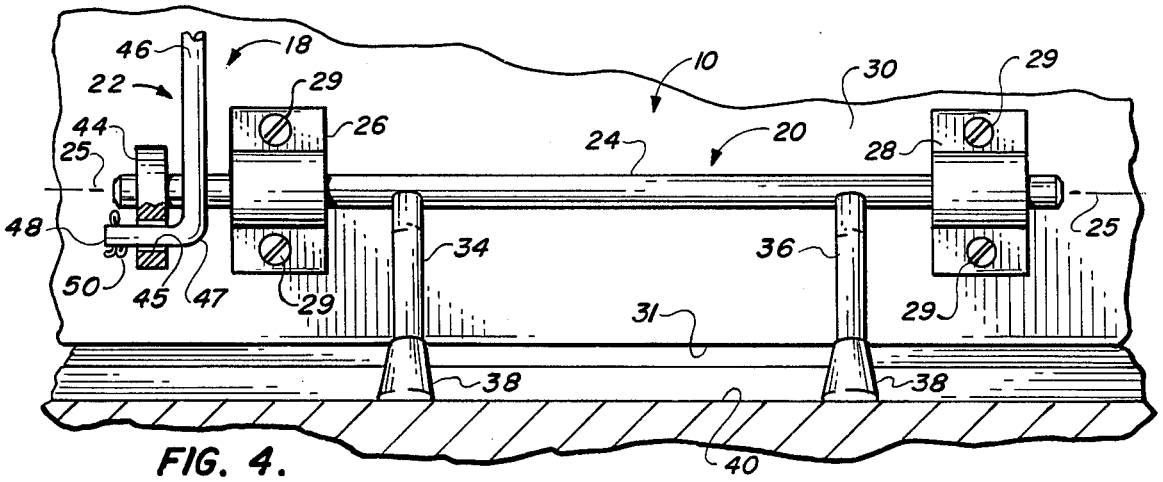
FIG. 4 is an enlarged fragmentary elevational view of the rockshaft and stop arm assembly of the door brace device.
Figure 5:
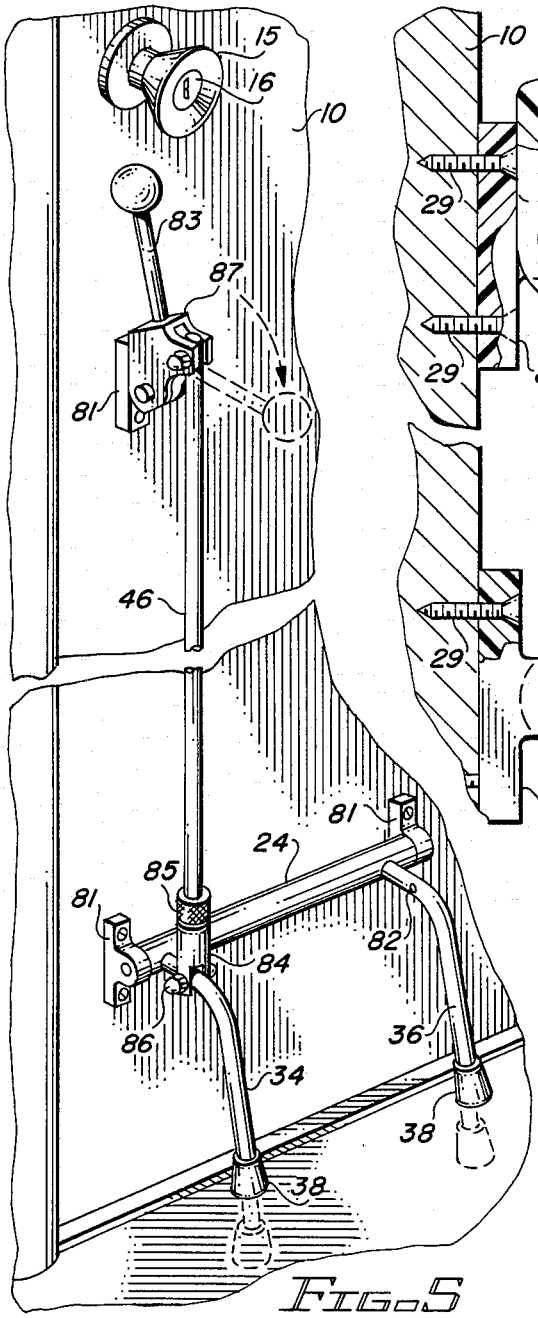
FIG. 5 is a fragmentary perspective view of the interior surface of a typical residential door with a second embodiment of the door security apparatus of the present invention mounted thereon.

Referring next to FIG. 5 through FIG. 9, a second embodiment of the apparatus for securing a door against unauthorized access is shown. The same numbers are used in these Figures for functionally equivalent elements in the first embodiment. In the second embodiment, three substantially equivalent pillow block brackets are used to fasten the security apparatus 90 to the interior surface 30 of door 10. Two of the pillow head brackets 81 are used to couple the rockshaft 24 to the door 10 so that the rockshaft 24 can be journaled about an axis (25 in FIG. 4) that is generally parallel to the base of the door 31 and the floor. In the second embodiment, the ends of the rockshaft 24 have a narrow extension that can be inserted into apertures in the pillow head brackets 81, the rockshaft 24 being too large to fit into the aperture. This configuration, in addition to permitting the journaling of the rockshaft 24, constrains the rockshaft 24 without additional apparatus when the pillow head brackets are fastened at an appropriate relative distance. The stop arms 34 and 36 are rigidly coupled to the rockshaft 24. Each stop arm has an aperture permitting the coupling of attachment nut 84 to the stop arm 34 or 36. A lock nut assembly 86 passes through the aperture in stop arm 34 and through apertures in the attachment nut. The pull rod 46 is threaded on the lower end 46A in such a manner as to screw into the attachment nut 84, the depth into which the pull rod 46 is screwed into the attachment nut providing an adjustment for the height of the pull rod 46. Locking ring 85 provides the means for constraining pull rod 46 from further rotation in attachment nut 84. The lower portion of the stop arm 34 and 36 are bent, in the second embodiment, from the projection of the stop arm where coupled to the rockshaft 24.

The upper end of the pull rod 46 has apertures fabricated therein. A lever assembly 87 has apertures fabricated therein and the apertures of the upper pull rod 46 are aligned therewith. The lock nut assembly 88 can be inserted in the apertures of the pull rod 46 and the lever assembly 87 and couple the two components, while permitting rotation therebetween. The lever assemble 87 has a second set of apertures fabricated therein. After the third pillow block bracket 81 has been attached to the door 10 by means of screws 29, the aperture in the third bracket 81 can be aligned with the apertures of lever assembly 87 and a lock nut assemble 89 inserted therethrough to permit the lever assembly to pivot about the axis formed by lock nut 89. A lever arm 83 is connected to lever assembly 87 to facilitate the pivoting action of the lever assembly 87 about the axis defined by lock nut assembly 89.

Figure 6:
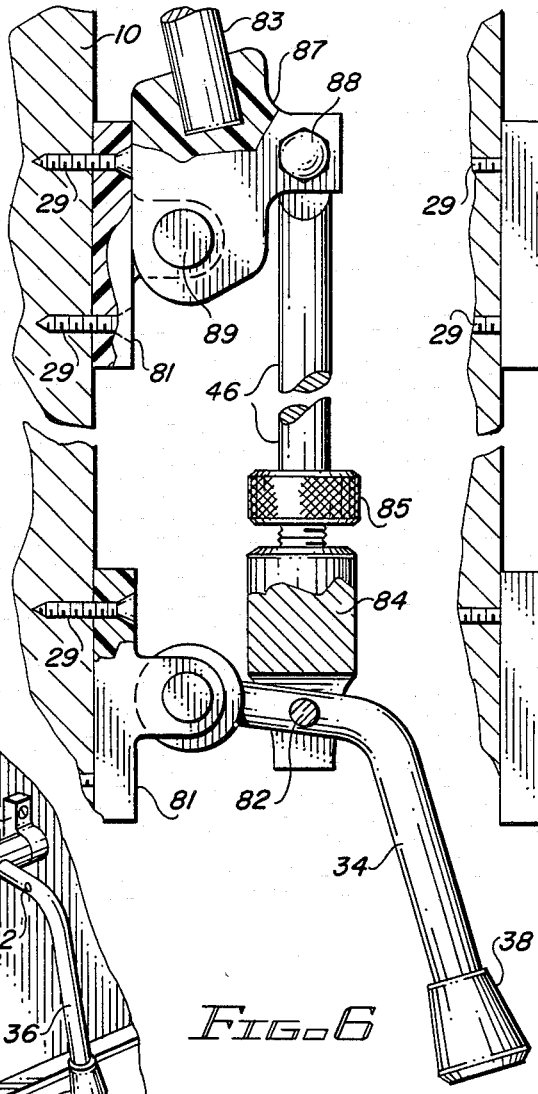
FIG. 6 is a fragmentary side view of the second embodiment of the present invention in a ready or waiting position.
Figure 7:
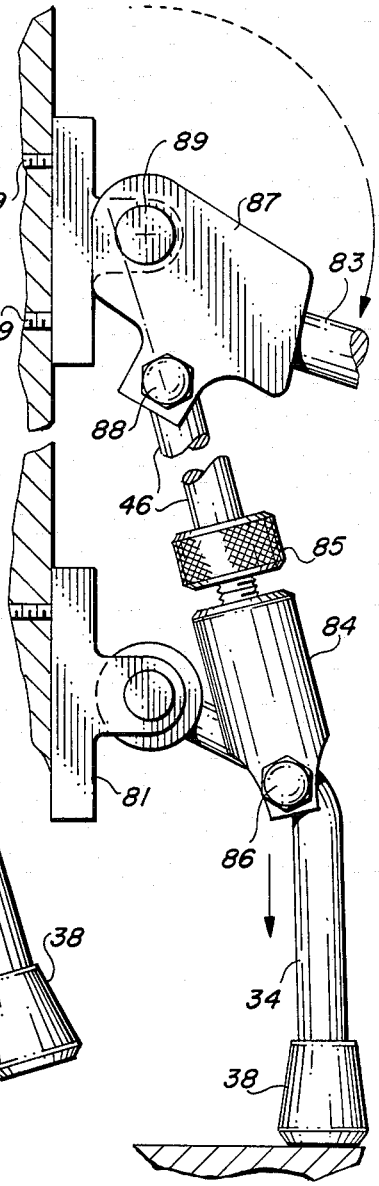
FIG. 7 is a fragmentary side view of the second embodiment of the present invention in the set or operational position.
Figure 8:
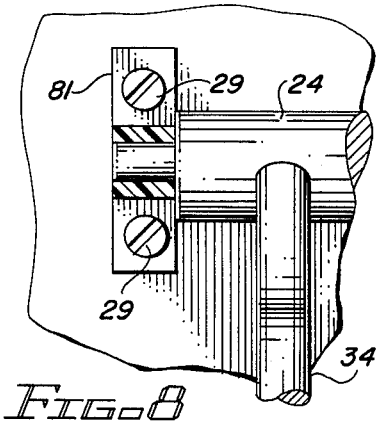
FIG. 8 is a detailed view of the coupling of the rock shaft to a pillow block bracket according to the second embodiment of the present invention.
Figure 9:
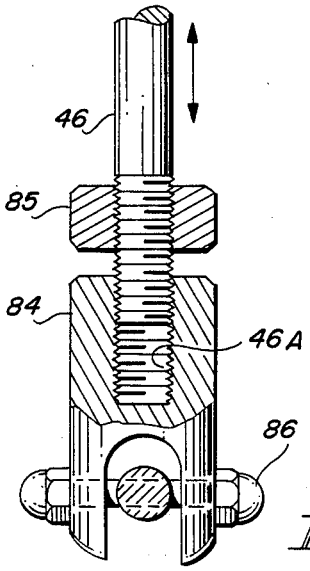
FIG. 9 is a detailed view of the coupling of the pull rod and the stop arm according to the second embodiment of the present invention.

Referring next to FIG. 6 and FIG. 7, the configuration of the present invention in the operational (active) position (FIG. 7) is contrasted with the configuration of the present invention in the ready (inactive) position (FIG. 6). When the lever arm 83 is rotated to the upper position, as shown in FIG. 6, the pivoting action of the lever assembly causes the pull rod to be lifted vertically. Because of the coupling to the stop arm 34, the rockshaft 24 is rotated lifting all of the stop arms out of contact with the floor 40. The door can thereafter be opened in the direction of the door security apparatus. When the lever arm 83 is rotated to the bottom position as shown in FIG. 7, the pivoting of the lever assembly causes the pull rod 46 to be lowered and forced in contact with the floor 40 (i.e., through friction foot means 38). In addition, the lever assembly 87 is rotated until the axis of the pull rod 46 extends behind the axis of the lock nut 89. In this position, the pull rod 46 is "locked" by the force exerted in a downward position by the third pillow block bracket and the force of the stop arm in the upward direction. This locking action can be removed only by the rotation of the lever arm 83 out of the operational position.

To insure that the proper force is exerted on the stop arm 34, the pull rod 46 can be rotated in the attachment nut 84 to control the vertical extension of the pull rod 46. The locking ring can be used to maintain the correct vertical extension. This adjustment increases the tolerances within which the pillow block brackets can be mounted and still function in a satisfactory manner. The coupling of the apparatus directly to the stop arm 34 or 36 eliminates the coupling apparatus of the previous embodiment and provides flexibility with respect to the position on the door of the lever arm 83.

The door security apparatus 18 provides several advantages over the thereinbefore discussed prior art door security devices. First among these advantages is the highly visible appearance of the device which allows the occupant to readily ascertain the set or unset position of the security apparatus. Secondly, when unauthorized opening of the door 10 is attempted, the apparatus 18 will increase its resistance to the unauthorized opening. All prior door security devices known to me will, on the other hand, remain passive and will at some point yield to the opening forces applied to the door. For example, a dead bolt will tear its socket member out of the door jam if enough force is applied to the door. And, a chain type will rip one or the other of its mounting brackets away from either the door or the door jamb.

In addition to the above advantages, the door security apparatus 18 is simple to install and such installation is within the skills of most people.

The second embodiment of the present invention has the added features of fewer parts, a more convenient latching mechanism, selective positioning of the lever arm and an adjustable pull rod length which reduces the criticality of the positioning of the door security apparatus on the door.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true scope of the invention.

What is claimed is:

1. A door security apparatus for attachment to the inwardly facing surface of an inwardly opening door for bracing the door against undesired opening, said door security apparatus comprising:

a first, a second and a third bracket, each of said brackets having an aperture fabricated therein, each of said brackets including structure permitting attachment to said inwardly facing door surface;

a rockshaft having a narrow extension at each end, said narrow extension capable of being inserted in said bracket apertures, wherein said rockshaft is too large to be inserted in said bracket apertures, said first and said second bracket for being coupled to said inwardly facing door surface to secure rotatably said rockshaft generally parallel to a floor surface;

a plurality of stop arms each extending from said rockshaft in a plane generally normal to an axis of said rockshaft, wherein at least one of said stop arms has an aperture fabricated therein;

attachment means capable of being coupled to one of said stop arm apertures, said attachment means including a threaded aperture;

a pull rod having a first end capable of threadedly engaging said attachment means threaded aperture and a second end having an aperture fabricated therein;

a locking ring threadedly coupled to said first pull rod end for controlling a depth of penetration by said pull rod into said attachment means threaded aperture; and lever means having a first and a second aperture fabricated therein, said first lever means aperture rotatably coupled to said pull rod second end aperture, said second lever means aperture being rotatably coupled to said third bracket aperture, said third bracket being coupled to said inwardly facing door surface relative to said first and said second brackets to provide a first rotational orientation of said lever means in which said stop arms engage said floor, said lever means being prevented from further rotation by a force on an outer surface of said door in said first rotational orientation, said lever means having a second rotational orientation in which the said stop arms do not engage said floor, wherein said locking ring adjusts a lever means orientation relative to a rockshaft orientation.

2. The door security apparatus of claim 1 wherein said first, said second and said third bracket are interchangeable.

3. The door security apparatus of claim 1 wherein said lever means includes a handle for manual rotation of said lever means.

4. The door security apparatus of claim 1 wherein said stop arms have friction means associated therewith to increase the force of friction between said stop arms and said floor surface.

5. The door security apparatus of claim 1 wherein each of said stop arms have a bend of approximately 60° generally in a plane normal to an axis of said rockshaft.

6. A door security apparatus for resisting undesired opening of a door comprising:

a first, a second and a third bracket, each of said brackets having structure permitting attachment to an inner surface of said door;

a rockshaft coupled to said first and said second bracket, said first and said second bracket being coupled to said door inner surface;

at least a first and a second stop arm each extending from said rockshaft in a plane generally normal to an axis of said rockshaft, said first and said second stop arms having apertures fabricated therein, wherein said first and said second brackets couple said rockshaft rotatably to said door inner surface generally parallel to a floor surface, said rockshaft positioned on said door in a manner that rotation of said rockshaft causes said stop arms to contact said floor surface;

a lever body coupled to said door surface by said third bracket, said lever body capable of rotating in a plane generally normal to said rockshaft;

a pull rod coupled to said lever body;

attachment means for coupling said pull rod to a one of said stop arms, said attachment means including apparatus for controlling a distance between said coupled stop arm and said lever body; said lever body having a first rotational orientation wherein wherein said stop arms are in contact with said floor surface and wherein a force on said stop arms toward said door will not result in lever body rotation, said lever body having a second rotational orientation wherein said stop arms do not contact said floor surface.

7. The door security apparatus of claim 6 wherein said lever body includes a lever arm for manually rotating said lever body.

8. The door security apparatus of claim 7 wherein said first, said second and said third brackets have substantially the same dimensions.

9. The door security apparatus of claim 8 wherein each of said stop arms are bent through an angle of approximately 60° in a plane normal to said rockshaft axis.

10. The door security apparatus of claim 9 wherein said attachment apparatus includes a threaded aperture capable of receiving a threaded end of said pull rod, said attachment apparatus further including a locking ring threadedly coupled to said pull rod for controlling movement in said threaded aperture by said pull rod.

* * * * *